US005205040A

United States Patent [19]

Werner

[11] Patent Number: 5,205,040

[45] Date of Patent: Apr. 27, 1993

[54] APPARATUS FOR SHAVING

[76] Inventor: Eric J. Werner, 705 Westminster Rd., Hermitage, Pa. 16148

[21] Appl. No.: 954,408

[22] Filed: Sep. 29, 1992

Related U.S. Application Data

[63] Continuation of Ser. No. 788,105, Nov. 5, 1991.

[51] Int. Cl.[5] ..... B26B 21/00; B26B 21/24; B26B 21/54

[52] U.S. Cl. ..... 30/50; 30/52; 30/346.56

[58] Field of Search ..... 30/50, 51, 52, 48, 89, 30/346.46, 346.55, 346.56, 346.58, 346.59

[56] References Cited

U.S. PATENT DOCUMENTS

| | | | |
|---|---|---|---|
| 2,213,062 | 8/1940 | Brandenthaler | 30/72 |
| 2,319,980 | 5/1943 | Des Jardins | 30/50 |
| 3,465,436 | 9/1969 | Musso | 30/346.56 |
| 3,597,841 | 8/1971 | Miller | 30/72 |
| 3,872,588 | 3/1975 | Bogaty | 30/50 |
| 4,754,548 | 7/1988 | Solow | 30/50 |

*Primary Examiner*—Frank T. Yost
*Assistant Examiner*—Paul M. Heyrana
*Attorney, Agent, or Firm*—Ansel M. Schwartz

[57] ABSTRACT

The present invention pertains to an apparatus for shaving. The apparatus for shaving comprises at least one blade having an essentially straight and essentially continuous cutting edge. The blade is comprised of a plurality of pliable blade segments aligned adjacent to each other to form the essentially straight and essentially continuous cutting edge such that each blade segment is capable of being deflected in a direction perpendicular to the cutting edge independently with respect to the other blade segments by a surface while in contact with the surface during shaving of the surface. The apparatus is also comprised of a rectangular shaped head which holds the blade in a desired orientation. Additionally, the apparatus is comprised of a handle connected to the head. In a preferred embodiment, there can be two blades held in the head in a tandem relationship. Preferably, the head holds the blade such that the blade segments are freestanding and not prestressed.

17 Claims, 3 Drawing Sheets

APPARATUS FOR SHAVING

This is a continuation of copending application Ser. No. 07/788,105 filed on Nov. 5, 1991 and which designated the U.S.

FIELD OF THE INVENTION

The present invention is related to an apparatus for shaving. More specifically, the present invention is related to an apparatus for shaving of the type in which portions thereof are movable during a shaving operation to effect dynamic changes in the shaving geometry of the unit.

BACKGROUND OF THE INVENTION

In some known shaving units, the shaving geometry, i.e., the spatial relationships between the blade and rigid portions of the razor head are fixed. U.S. Pat. No. 3,786,563, issued Jan. 22, 1974 to Francis W. Dorion, et al. is illustrative of this type of razor unit. In a second known category of shaving units, the shaving geometry is adjustable in that one or more of the portions of the unit may be re-positioned relative to the others, by the user, and remain in their new positions until selectively re-adjusted.

It has also been proposed to construct a shaving system with a cap member fixed relative to a handle and with blade and guard members made fast with each other and spring biased to a position of maximum blade exposure, the blade and guard members being adapted to retract against the spring bias upon encountering undue resistance during shaving. An arrangement of this sort is described in U.S. Pat. No. 4,063,354, issued Dec. 20, 1977 to Harry Pentney et al.

Several arrangements of shaving units permitting dynamic movement of various portions thereof during a shaving operation have been devised; examples of such contrivances are illustrated in U.S. Pat. Nos. 1,935,452 issued Nov. 14, 1933 to M. R. Kondolf; 2,313,818 issued Mar. 16, 1943 to H. J. Gaisman; 2,327,967 issued Aug. 24, 1943 to P. N. Peters; 2,915,817 issued Dec. 8, 1959 to E. Peck; 3,500,539 issued Mar. 17, 1970 to J. P. Muros; 3,657,810 issued Apr. 25, 1972 to W. I. Nissen; 3,685,150 issued Aug. 22, 1972 to F. L. Risher; and 3,740,841 issued Jun. 26, 1973 to F. L. Risher, as well as U.S. Pat. Nos. 3,880,284, 4,026,016, 4,168,571, 4,170,821, 4,270,268, 4,379,219, 4,492,024, 4,498,235, 4,551,916, 4,573,266, 4,586,255, 4,621,424 and 4,742,909, all of which are incorporated by reference.

SUMMARY OF THE INVENTION

The present invention pertains to an apparatus for shaving. The apparatus for shaving comprises at least one blade having an essentially straight and essentially continuous cutting edge. The blade is comprised of a plurality of pliable blade segments aligned adjacent to each other to form the essentially straight and essentially continuous cutting edge such that each blade segment is capable of being deflected in a direction perpendicular to the cutting edge independently with respect to the other blade segments by a surface while in contact with the surface during shaving of the surface. The apparatus is also comprised of a rectangular shaped head which holds the blade in a desired orientation. Additionally, the apparatus is comprised of a handle connected to the head. In a preferred embodiment, there can be two or more blades held in the head in a tandem relationship. Preferably, the head holds the blade such that the blade segments are freestanding and not prestressed.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
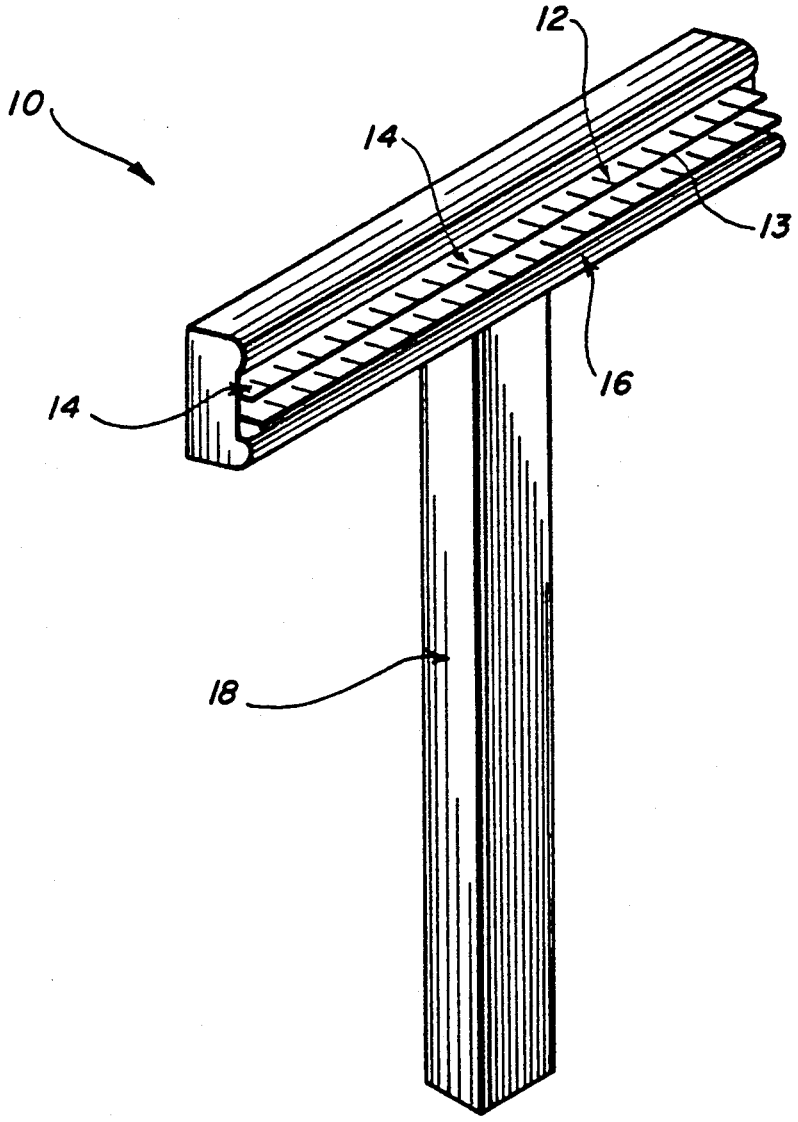
FIG. 1 is a perspective schematic representation of an apparatus for shaving.

Referring now to the drawings wherein like reference numerals refer to similar or identical parts throughout the several views, and more specifically to FIG. 1 thereof, there is shown an apparatus 10 for shaving. The apparatus 10 comprises at least one blade 12 having preferably an essentially straight and essentially continuous cutting edge 13. The blade 12 is comprised of a plurality of pliable blade segments 14 aligned adjacent to each other to form the essentially straight and essentially continuous cutting edge 13. This blade construction allows each blade segment 14 to deflect in a direction perpendicular to the cutting edge 13 independently with respect to the other blade segments by a surface while in contact with the surface during shaving of the surface 14. Thus, during shaving, when the blade encounters a variance in skin/surface contour within the dimension of the blade, the particular blade segments 14 can deflect to allow the other blade segments 14 to remain in continuous contact with the skin and have less likelihood of unintentionally cutting or nicking the surface.

The apparatus 10 also comprises a rectangular shaped head 16 for holding the blade 12 in the proper orientation and a handle 18 connected to the head 16. The blade can be held by the head along its sides, along its back opposing its cutting edge 13, or both. The blade can be held by the head 16 in a flexible mounting such as that of the Schick Tracer TM, with, for instance, a head 16 being made out of a polymer type material. The flexible material affords a further degree of automatic adjustability to the blade so the skin can be more closely contacted across the blade during shaving. Preferably, the head holds the blade such that the blade segments are freestanding and not prestressed.

Preferably, the apparatus 10 comprises two blades 12 which are disposed in the head 16 in a tandem relationship. Preferably, the blade segments 14 of one blade 12 are offset from the blade segments 14 of the other blade 12. This offset arrangement allows the blades 12 to shave closer to the face along the variation in contour than would otherwise be obtainable if the blade segments 14 of each blade 12 were aligned and not miss spots due to deflection of other blade segments or gaps between blade segments. Preferably, the head 16 is removably connected to the handle 18 such that once the blades become dull and/or soiled, the head 16 can be removed and new head 16 can be installed on the handle in its place as is well known in the art.

Figure 2:
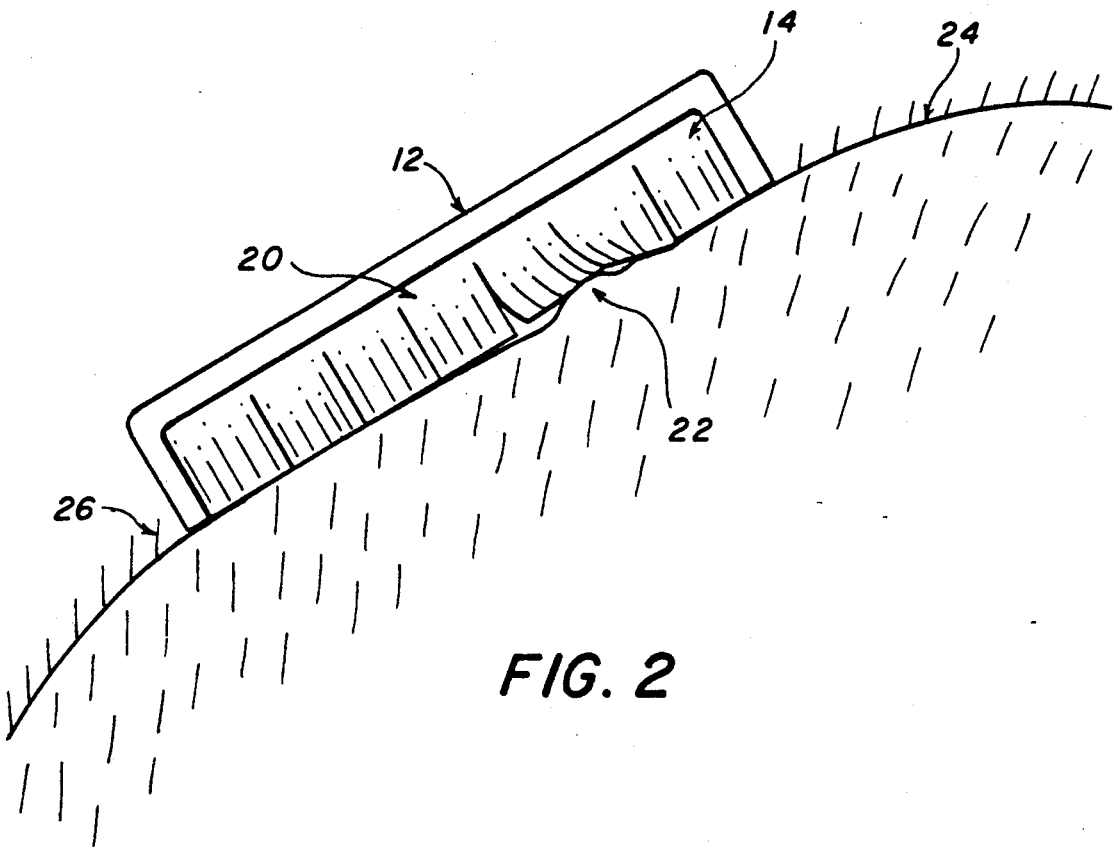
FIG. 2 is a schematic representation of a portion of the apparatus for shaving adjacent a portion of skin with whiskers.
Figure 4:
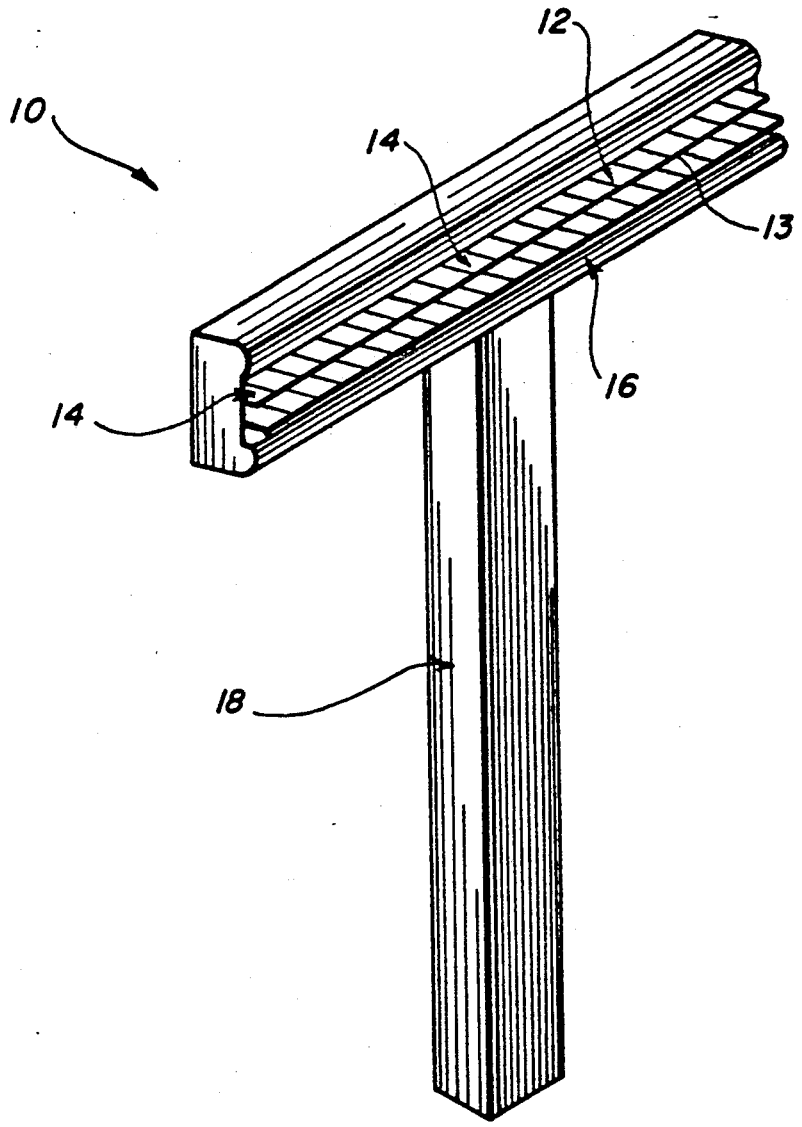
FIG. 4 is a schematic representation of an alternative embodiment of the apparatus for shaving.

As shown in FIG. 2, each blade 12 preferably comprises a strip 20 to which the blade segments 14 are integrally attached, although this blade can be formed of individual segments 14 individually attached to the head 16 as shown in FIG. 4. In this manner, the blade segments 14 can be formed by cutting a series of slices partially through the pliable blade 12. The blade segments 14 can be cut individually, or preferably in groups simultaneously, using standard machining tools, lasers or ultra precise water jets. There should be as little space as possible between the cutting edge formed by the segments 14 to maximize the overall cutting surface and not miss spots. The individual segments 14 when formed should also be as smoothly and cleanly cut as possible to provide less risk of nicks and permit blades to move independently without restriction. The segments 14 are preferably less than ¼ inches across. The blade 12 is preferably comprised of stainless steel so that it does not oxidize.

Figure 3:
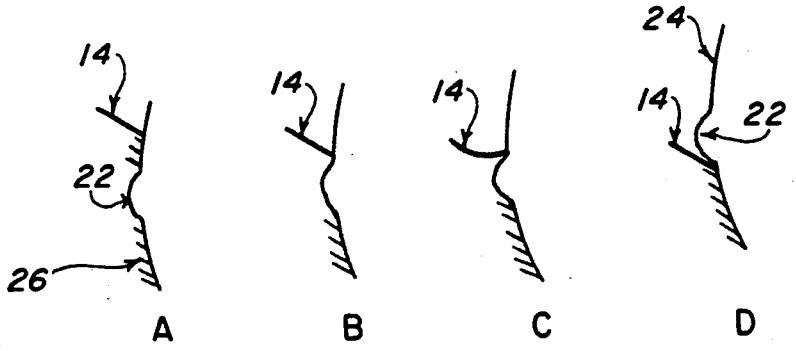
FIGS. 3A–3D are schematic representations of a blade as it moves across skin with whiskers.

In the operation of the apparatus 10 for shaving, the independent deflection action of the blade segments 14 permits greater degrees of conformability to contours than previously known. During shaving, and as shown in FIG. 2, when the blade 12 encounters a ridge 22 on a shaving surface 24, such as skin, the blade segment 14 adjacent to the ridge 22 deflects thereby allowing the remaining blade segments 14 to stay in contact with the shaving surface 24 to continue shaving. FIGS. 3A–3D show side views of a blade segment 14 as it encounters a ridge. In FIG. 3A, the blade segment 14 is shaving normally cutting the hair stubble 26 from the shaving surface 24. FIG. 3B shows the blade segment 14 as it encounters the ridge 22. Since the blade segment 14 is pliable, continued forward motion causes the blade segment to deflect as shown in FIG. 3C. In this manner, the blade segments 14 can "ride-over" the ridge 22 and have less harm of nicks and permit the blades to move independently while the other blade segments remain in contact with the skin/surface to continue normal shaving. Eventually, as shown in FIG. 3D, the blade segment 14 springs back to its original position in alignment with the other blade segments 14.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for shaving comprising:

blade means which comprises at least one blade having an essentially straight and essentially continuous cutting edge, said blade comprised of a plurality of pliable blade segments aligned adjacent to each other to form the straight and essentially continuous cutting edge such that each blade segment is capable of being deflected in a direction perpendicular to the cutting edge independently with respect to the other blade segments by a surface while in contact with the surface during shaving of the surface;

a rectangular shaped head which holds said blade in a desired orientation; and a handle connected to said head.

2. An apparatus as described in claim 1 wherein there is as little space as possible between the segments along the cutting edge to maximize the overall cutting edge of the blade.

3. An apparatus as described in claim 2 wherein two blades are held in the head in a tandem relationship.

4. An apparatus as described in claim 3 wherein the blade segments of one blade are offset from the blade segments of the other blade.

5. An apparatus as described in claim 4 wherein the head is removably connected to said handle.

6. An apparatus as described in claim 1 wherein the blade comprises a strip to which the blade segments are integrally connected.

7. An apparatus as described in claim 6 wherein the blade is made of stainless steel.

8. An apparatus as described in claim 7 wherein each blade segment is less than ¼ inch across.

9. An apparatus for shaving comprising:

blade means which comprises at least one blade having an essentially straight and essentially continuous cutting edge, said blade comprised of a plurality of pliable blade segments aligned adjacent to each other to form the straight and essentially continuous cutting edge such that each blade segment is capable of being deflected in a direction perpendicular to the cutting edge independently with respect to the other blade segments by a surface while in contact with the surface during shaving thereof, and a strip to which each blade segment is integrally attached;

a rectangular shaped head which holds said blade in a desired orientation, said head made of a flexible material; and a handle connected to said head.

10. An apparatus as described in claim 9 wherein there is as little space as possible between the segments along the cutting edge to maximize the overall cutting edge of the blade.

11. An apparatus as described in claim 10 wherein two blades are held in the head in a tandem relationship.

12. An apparatus as described in claim 11 wherein the blade segments of one blade are offset from the blade segments of the other blade.

13. An apparatus as described in claim 12 wherein the head is removably connected to said handle.

14. An apparatus as described in claim 13 wherein the blade comprises a strip to which the blade segments are integrally connected.

15. An apparatus as described in claim 14 wherein the blade is made of stainless steel.

16. An apparatus as described in claim 15 wherein each blade segment is less than ¼ inch across.

17. An apparatus for shaving comprising:

blade means which comprises at least one blade having a cutting edge, said blade comprised of a plurality of pliable blade segments aligned adjacent to each other to form the cutting edge such that each blade segment is capable of being deflected in a direction perpendicular to the cutting edge independently with respect to the other blade segments by a surface while in contact with the surface during shaving of the surface;

a head which holds said blade in a desired orientation such that the blade segments are freestanding and not prestressed; and a handle connected to said head.

* * * * *